US006718772B2

(12) United States Patent
Dalla Betta et al.

(10) Patent No.: US 6,718,772 B2
(45) Date of Patent: Apr. 13, 2004

(54) METHOD OF THERMAL NOX REDUCTION IN CATALYTIC COMBUSTION SYSTEMS

(75) Inventors: Ralph A. Dalla Betta, Mountain View, CA (US); Marco A. Velasco, Milpitas, CA (US); David K. Yee, Hayward, CA (US); Sarento G. Nickolas, San Jose, CA (US)

(73) Assignee: Catalytica Energy Systems, Inc., Mountain View, CA (US)

( * ) Notice: Subject to any disclaimer, the term of this patent is extended or adjusted under 35 U.S.C. 154(b) by 39 days.

(21) Appl. No.: 10/040,208

(22) Filed: Oct. 26, 2001

(65) Prior Publication Data

US 2002/0083715 A1 Jul. 4, 2002

Related U.S. Application Data

(60) Provisional application No. 60/244,019, filed on Oct. 27, 2000.

(51) Int. Cl.[7] ..... F02C 7/22
(52) U.S. Cl. ..... 60/776
(58) Field of Search ..... 60/723, 775, 776, 60/777, 722, 724, 732, 734, 740, 755; 431/7, 170

(56) References Cited

U.S. PATENT DOCUMENTS

| | | | | |
|---|---|---|---|---|
| 3,928,961 A | * | 12/1975 | Pfefferle | 60/39.02 |
| 3,975,900 A | | 8/1976 | Pfefferle | |
| 4,197,701 A | * | 4/1980 | Boyum | 60/39.06 |
| 4,473,536 A | | 9/1984 | Carberg et al. | |
| 4,534,165 A | | 8/1985 | Davis, Jr. et al. | |
| 4,726,181 A | * | 2/1988 | Pillsbury | 60/723 |
| 4,731,989 A | | 3/1988 | Furuya et al. | |
| 4,966,001 A | | 10/1990 | Beebe | |
| 5,133,180 A | | 7/1992 | Horner et al. | |
| 5,139,755 A | | 8/1992 | Seeker et al. | |
| 5,161,366 A | | 11/1992 | Beebe | |
| 5,165,224 A | | 11/1992 | Spadaccini et al. | |
| 5,183,401 A | | 2/1993 | Dalla Betta et al. | |
| 5,232,357 A | | 8/1993 | Dalla Betta et al. | |
| 5,235,804 A | | 8/1993 | Colket, III et al. | |
| 5,248,251 A | | 9/1993 | Dalla Betta et al. | |
| 5,250,489 A | | 10/1993 | Dalla Betta et al. | |
| 5,259,754 A | | 11/1993 | Dalla Betta et al. | |
| 5,263,325 A | | 11/1993 | McVey et al. | |

(List continued on next page.)

FOREIGN PATENT DOCUMENTS

WO WO 02/068867 9/2002

OTHER PUBLICATIONS

U.S. patent application Ser. No. 09/942,976, Yee et al., filed Aug. 29, 2001.

(List continued on next page.)

*Primary Examiner*—Justine R. Yu
*Assistant Examiner*—John F. Belena
(74) *Attorney, Agent, or Firm*—Morrison & Foerster LLP

(57) ABSTRACT

Methods and apparatus, both devices and systems, for control of Zeldovich (thermal) NOx production in catalytic combustion systems during combustion of liquid or gaseous fuels in the post catalytic sections of gas turbines by reducing combustion residence time in the HC zone through control of the HC Wave, principally by adjusting the catalyst inlet temperature. As the fuel/air mixture inlet temperature (to the catalyst) is reduced, the HC Wave moves downstream (longer ignition delay time), shortens the residence time at high temperature, thereby reducing thermal NOx production. The countervailing increase in CO production by longer ignition delay times can be limited by selectively locating the HC Wave so that thermal NOx is reduced while power output and low CO production is maintained. NOx is reduced to on the order of <3 ppm, and preferably <2 ppm, while CO is maintained <100 ppm, typically <50 ppm, and preferably <5–10 ppm.

55 Claims, 4 Drawing Sheets

*NOx produced vs. Temperature in a catalytic combustion system*

U.S. PATENT DOCUMENTS 5,263,998 A 11/1993 Mackrodt et al.
5,269,679 A 12/1993 Syska et al.
5,281,128 A * 1/1994 Dalla Betta et al. ..... 431/7
5,318,436 A 6/1994 Colket, III et al.
5,413,477 A 5/1995 Moreland
5,425,632 A 6/1995 Tsurumi et al.
5,452,574 A 9/1995 Cowell et al.
5,461,855 A 10/1995 Inoue et al.
5,461,864 A 10/1995 Betta et al.
5,511,972 A 4/1996 Dalla Betta et al.
5,512,250 A 4/1996 Betta et al.
5,518,697 A 5/1996 Dalla Betta et al.
5,551,239 A * 9/1996 Feeley et al. ..... 60/723
5,551,869 A 9/1996 Brais et al.
5,554,021 A 9/1996 Robertson et al.
5,569,020 A 10/1996 Griffin et al.
5,581,997 A 12/1996 Janes
5,634,784 A 6/1997 Pfefferle et al.
5,826,429 A * 10/1998 Beebe et al. ..... 60/723
5,879,148 A 3/1999 Cheng et al.
5,896,738 A 4/1999 Yang et al.
5,913,675 A 6/1999 Vago et al.
5,937,632 A 8/1999 Döbbeling et al.
5,937,634 A 8/1999 Etheridge et al.
5,957,682 A 9/1999 Kamal et al.
5,965,001 A 10/1999 Chow et al.
5,985,222 A 11/1999 Sudduth et al.
6,000,212 A 12/1999 Kolaczkowski et al.
6,038,861 A 3/2000 Amos et al.
6,066,303 A 5/2000 Sudduth et al.
6,082,111 A 7/2000 Stokes
6,089,855 A 7/2000 Becker et al.
6,094,916 A 8/2000 Puri et al.
6,095,793 A 8/2000 Greeb
6,105,360 A 8/2000 Willis
6,109,018 A 8/2000 Rostrup-Nielsen et al.
6,116,014 A 9/2000 Dalla Betta et al.
6,122,916 A 9/2000 Amos et al.
6,201,029 B1 3/2001 Waycuilis
6,217,832 B1 4/2001 Betta et al.
6,226,977 B1 5/2001 Ichiryu et al.
6,237,343 B1 5/2001 Butler
6,250,877 B1 6/2001 Westphal et al.
6,280,695 B1 8/2001 Lissianski et al.
6,286,482 B1 9/2001 Flynn et al.
6,289,667 B1 9/2001 Kolaczkowski et al.
6,298,654 B1 10/2001 Vermes et al.
2001/0046650 A1 11/2001 Smith et al.

OTHER PUBLICATIONS

Felder, R.M. and Rousseau, R.W. (1978). "Elementary Principles of Chemical Processes," John Wiley and Sons, New York. p. 414.

Lefebvre, A. H. (Sep. 1998). *Gas Turbine Combustion*. Hemisphere Publishing Corporation. (Table of Contents) and pp. 49 and 192.

* cited by examiner

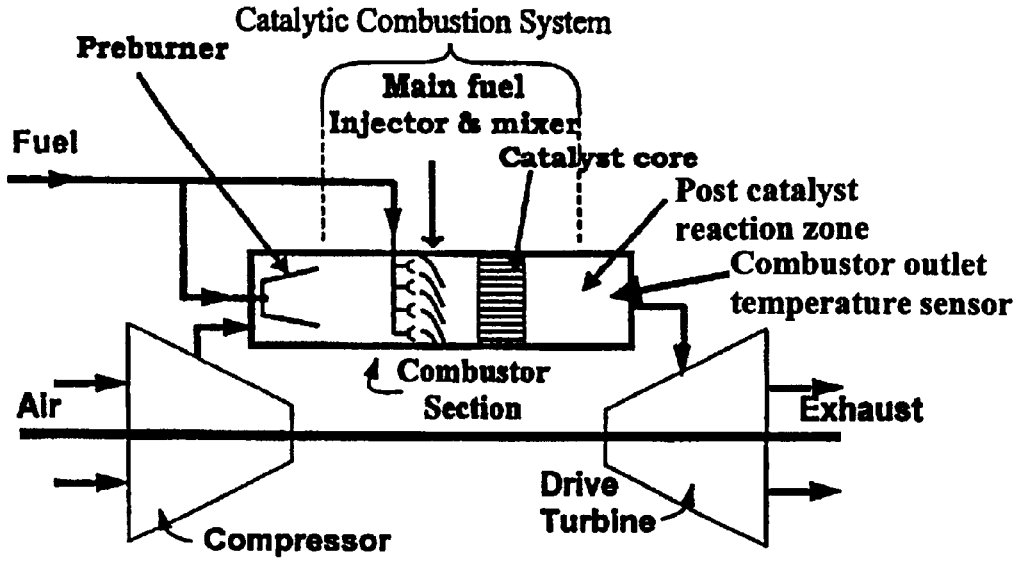
*Figure 1, Prior Art*
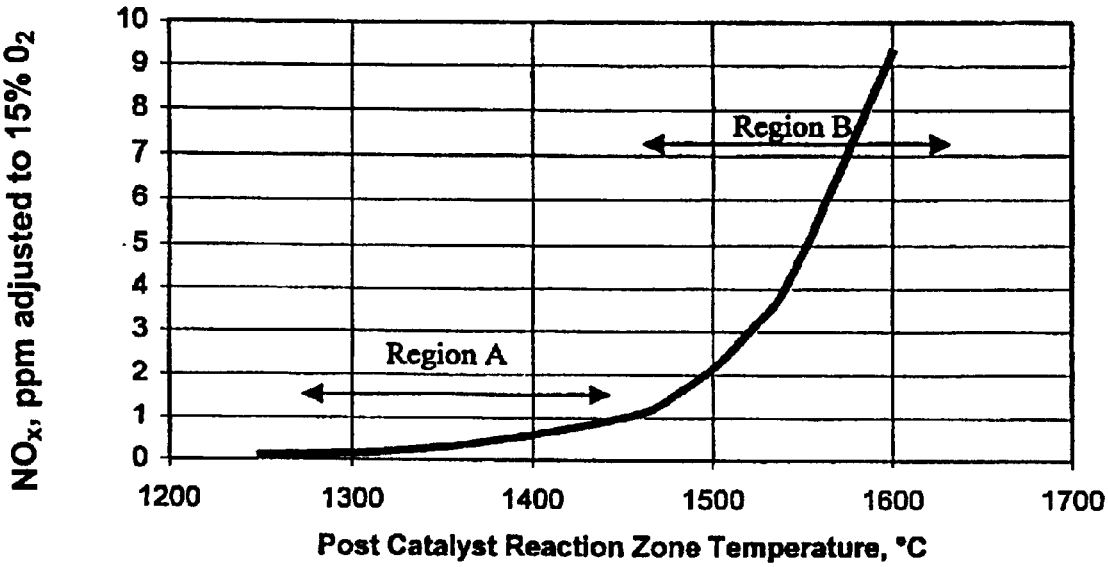
*Figure 2, NOx produced vs. Temperature in a catalytic combustion system*

METHOD OF THERMAL NOX REDUCTION IN CATALYTIC COMBUSTION SYSTEMS

CROSS REFERENCE TO RELATED APPLICATIONS

This application is the Regular U.S. Application of our earlier-filed Provisional Application entitled METHOD OF NOx REDUCTION IN CATALYTIC COMBUSTION SYSTEMS, Ser. No. 60/244,019 filed Oct. 27, 2000. This application is related to co-pending Ser. No. 09/942,976 filed Aug. 29, 2001 by us entitled CONTROL STRATEGY FOR FLEXIBLE CATALYTIC COMBUSTION SYSTEM. The benefits of the filing and priority dates of these applications are hereby claimed under 35 U.S. Code, §§119 and 120.

FIELD OF THE INVENTION

The invention relates to methods and apparatus, both devices and systems, for control of NOx in catalytic combustion systems, and more particularly the control of NOx produced downstream of the catalytic reaction zone of a combustor, while at the same time maintaining the same power output yet low CO, by reducing combustion residence time, inter alia, through control of the location of the homogeneous combustion wave.

BACKGROUND

Gas turbines are used for a variety of purposes, among them: motive power; gas compression; and generation of electricity. The use of gas turbines for electrical generation is of particular and growing interest due to a number of factors, among them being modularity of design, generation output capacity to size and weight, portability, scalability, and efficiency. In addition, gas turbines generally use low sulfur hydrocarbon fuels, principally natural gas, which offers the promise of lower sulfur oxides or SOx pollutant output. This is particularly important in urban areas that use, or can use, gas turbines for power generation, as they are attractive for power-grid supply in-fill to cover growing power needs as urban densification occurs.

Gas turbines tend to operate with a high turbine inlet temperature, in the range of from about 1100° C. for moderate efficiency turbines, to 1500° C. for modern high efficiency engines. To achieve these temperatures at the turbine inlet, the combustion system must produce a somewhat higher temperature, generally 1200 to 1600° C. as a result of some air addition due to seal leakage or the purposeful addition of air for cooling of portions of the gas turbine structure. At these temperatures, the combustion system will produce NOx. The amount of NOx produced increases as the temperature increases. However, to meet ever more stringent emissions standards, turbine operating conditions must be controlled so that the amount of NOx produced does not increase.

A typical gas turbine system comprises a compressor upstream of, and feeding compressed air to, a combustor section in which fuel is injected and burned to provide hot gases to the drive turbine located just downstream of the combustor. FIG. 1 shows such a prior art system employing a catalytic combustion system in the combustor section. FIG. 1 shows a conventional system of the type described in U.S. Pat. No. 5,183,401 by Dalla Betta et al., U.S. Pat. No. 5,232,357 by Dalla Betta et al., U.S. Pat. No. 5,250,489 by Dalla Betta et al., U.S. Pat. No. 5,281,128 by Dalla Betta et al., and U.S. Pat. No. 5,425,632 by Tsurumi et al. These types of turbines employ an integrated catalytic combustion system in the combustor section. Note the combustor section comprises the apparatus system between the compressor and the drive turbine.

As shown in FIG. 1 the illustrative combustor section comprises: a housing in which is disposed a preburner; fuel source inlets; catalyst fuel injector and mixer; one or more catalyst sections; and a post catalyst reaction zone. The preburner burns a portion of the total fuel to raise the temperature of the gas mixture entering the catalyst, and some NOx is formed there. Additional fuel is introduced downstream of the preburner and upstream of the catalyst and is mixed with the process air by an injector mixer to provide a fuel/air mixture (F/A mixture). The F/A mixture is introduced into the catalyst where a portion of the F/A mixture is oxidized by the catalyst, further raising the temperature. This partially combusted F/A mixture then flows into the post catalyst reaction zone wherein auto-ignition takes place a spaced distance downstream of the outlet end of the catalyst module. The remaining unburned F/A mixture combusts in what is called the homogeneous combustion (HC) zone (within the post catalyst reaction zone), raising the process gases to the temperature required to efficiently operate the turbine. Note that in this catalytic combustion technology, only a portion of the fuel is combusted within the catalyst module and a significant portion of the fuel is combusted downstream of the catalyst in the HC zone.

Each type of drive turbine has a designed inlet temperature, called the design temperature. For proper operation of a gas turbine at high efficiency, the system or operator must control the outlet temperature of the combustor section to keep the temperature at the design-temperature of the drive turbine. This can be a very high temperature, in the range of 1100° C. for moderate efficiency gas turbines and as high as 1400 to 1600° C. for modern high efficiency engines. As shown in FIG. 1, at these high temperatures, NOx forms in the "Post catalyst reaction zone" of the combustor section. Although the NOx level produced in the post catalytic combustion zone is typically low for natural gas and similar fuels, it is still desirable to reduce this level even further to meet increasingly stringent emissions requirements.

FIG. 2 shows the relationship between the temperature in the post catalyst reaction zone and the amount of NOx produced, for a catalytic combustion system of the type shown in FIG. 1. At temperatures below about 1450° C., identified in the figure as Region A, the level of NOx produced is below 1 ppm. As seen in FIG. 2, at temperatures above about 1450° C., the Region B lower boundary, the NOx level rises rapidly, with 5 ppm produced at 1550° C., and even higher levels above that temperature, on the order of 9–10 ppm or higher.

The formation of NOx at a high temperature is a kinetically controlled process. A portion of the NOx, called "Prompt NOx," or "Fennimore NOx," forms in the region of the combustor where rapid reactions occur. The amount of Prompt NOx formed depends on the fuel-to-air ratio and final flame temperature, but this Prompt NOx stops forming once the flame-front has consumed most of the fuel. A second pathway to the formation of NOx is the "Thermal NOx" or "Zeldovich pathway," in which NOx is formed continuously at high temperatures and in quantities dependant only on time and temperature. In typical gas turbine systems with residence times in the range of 10 to 20 ms (milliseconds), the prompt and thermal pathways produce roughly the same amount of NOx.

In most combustion processes, reaction of the fuel occurs in a flame that is fixed in location by a flame holder. The flame holder can be either a physical object or an aerodynamic process to anchor or stabilize the flame. Physical elements include bluff bodies, v-gutters, or other such mechanical parts that recirculate the gas stream to stabilize the flame. Aerodynamic stabilizers include physical elements such as swirlers and vanes and such modifications as expanded flow area to stabilize the flame. Flame temperature, temperature profile, physical dimensions of the combustor, and other such features determine the thermal NOx formation. For example, the designer cannot change thermal NOx levels without changing the volume or length of the combustor or the position at which the combustor design anchors the flame.

In the case of a catalytic combustion system using the technology described in the above-identified U S Patents, and other references, only a portion of the fuel is combusted within the catalyst and a significant portion of the fuel is combusted down stream of the catalyst in a post catalyst homogeneous combustion (HC) zone. FIG. 3 schematically illustrates the downstream HC zone.

The top portion of FIG. 3 is an enlarged schematic of a portion of FIG. 1 showing the major components of a catalytic combustion system 12 located downstream of the preburner. The catalytic combustion system includes a catalyst fuel injector 11, one or more catalyst sections 13 and the post catalyst reaction zone 14 in which is located the HC (homogeneous combustion) zone 15. The bottom portion of FIG. 3 illustrates the temperature profile and fuel composition of the combustion gases as they flow through the combustor section described above. Temperature profile 17 shows gas temperature rise through the catalyst unit as a portion of the fuel is combusted. After a delay, called the ignition delay time 16, the remaining fuel reacts to give the full temperature rise. In addition, the corresponding drop in the concentration of the fuel 18 along the same path is shown as a dotted line.

As shown in the bottom portion of FIG. 3, a portion of the fuel is combusted, without flame, in the catalyst resulting in an increase in temperature of the gas mixture. The mixture exiting the catalyst is at an elevated temperature and contains the remaining unburned fuel in air. This hot fuel and air mixture autoignites in a homogeneous combustion process in which the remaining fuel reacts in a radical reaction process to form the final reaction products of $CO_2$ and $H_2O$, and the temperature rises to the final combustion temperature for the total entering fuel and air mixture.

There is a similar problem with CO in the combustor output gases, in that regulations currently require less than about 100 ppm, and the movement is toward 10 ppm or less. A concern is that in reducing NOx levels, there may be a countervailing CO increase, such that in order to meet NOx limits, CO is exceeded. Thus, finding the window of low NOx and acceptable CO is increasingly difficult at the high FIG. 2, Region B, temperatures needed for efficient energy extraction.

Accordingly, for gas turbines that require combustor outlet temperatures in Region B in order to achieve the required drive-turbine design temperatures, and where emissions requirements demand NOx emissions levels below 3 ppm and CO on the order of 50–100 ppm or less, there is a need in the art for better control of the combustion process and ignition timing, and for improved combustion systems, apparatus and controls, in order to ensure that the NOx level produced in the combustion section of a gas turbine system can be maintained at lower levels, for example, 2 ppm or less while maintaining CO below about 10 ppm.

THE INVENTION

Summary, Including Objects and Advantages:

The invention comprises methods and apparatus, both devices and systems, for control of Zeldovich (thermal) pathway NOx production in catalytic combustion systems, and more particularly to control of NOx produced during combustion of liquid or gaseous fuels in the post catalytic sections of gas turbines by reducing combustion residence time in the HC zone through control of the HC wave, principally by adjusting the catalyst inlet temperature.

The invention arises out of the discovery that in the typical combustor having a physical or aerodynamic flame holder, the fuel and air mixture is combusted in a fixed position and does not move significantly as process conditions are varied. In contrast moreover, it has been discovered, unexpectedly, that in a catalytic combustor system, the location of the postcatalyst homogeneous combustion process that results in a temperature rise is not connected to the physical flame process or fixed flame holder, but rather is controlled by the catalyst exit gas conditions. Accordingly, the process of the invention comprises controlling the catalyst outlet temperature, which changes the HC wave location, which in turn controls the time period (residence time) during which the flame produces thermal NOx. Accordingly, the process of the invention comprises controlling the catalyst outlet temperature, which changes the HC wave location, which in turn controls the time period (residence time) during which the flame produces thermal NOx while maintaining a substantially constant adiabatic temperature in the post catalyst burn out zone. As soon as the gas mixture enters the drive turbine, work is extracted and the gas temperature drops significantly and NOx formation stops. Thus, in accord with the invention, by reducing the residence time at high post-catalyst reaction temperatures, NOx can be reduced to <3 ppm, preferably <2 ppm, while CO is maintained to within acceptable limits of < 50–100 ppm, and even to <5–10 ppm.

This inventive feature is illustrated in FIG. 4, which shows a series of simple schematic drawings of a catalyst combustor system having a fuel injector, catalyst and post-catalyst homogeneous combustion zone feeding hot gas into a drive turbine. This series of figures illustrates schematically the change in the position of the homogeneous combustion wave, starting in FIG. 4A, with the HG wave being shown positioned downstream of the catalyst. The actual physical location of the HG wave is a function of the ignition delay time, $t_{ignition}$, as shown in FIG. 3, and the gas velocity. In FIG. 4B, the ignition delay is adjusted to be very long, so that after the ignition occurs and the high temperature is reached, the time that the gas mixture will be hot enough for thermal NOx formation is relatively short and NOx formation will be minimized. In FIG. 4A the ignition delay time is at an intermediate value and in FIG. 4C the ignition delay time is very short. In each of these later cases, the Zeldovich pathway NOx formed is progressively higher due to progressively longer times in which the gas mixture is at the high post-combustion temperature.

The catalyst outlet temperature can be changed by changing the operating conditions of the combustor system. For example, in a first embodiment of the control aspects of the invention, the amount of fuel fed to the preburner (shown in FIG. 1) is reduced, then the temperature entering the catalyst module will be lower and the temperature at the exit of the catalyst will also be lower. This lower temperature at the catalyst exit will move the homogeneous combustion wave farther downstream from the catalyst and closer to the turbine, thus reducing the level of thermal NOx formed. Similarly, increasing the fuel to the preburner will increase the catalyst outlet temperature, move the homogenous combustion wave upstream and increase the amount of thermal NOx formed. Other control embodiments are described below in the Detailed Description section of this Application.

The inventive control of the location of the HC Wave to reduce the thermal NOx output is an unexpected and very unusual aspect of catalytic combustion systems employing the partial downstream combustion technology described here.

BRIEF DESCRIPTION OF THE DRAWINGS

The invention is described by reference to the drawings in which:

FIG. 1 is a schematic diagram of a typical prior art gas turbine showing the major components and using an integrated catalytic combustion system in the combustor section;

FIG. 2 is a graph of NOx produced vs Temperature in a catalytic combustion system and showing low temperature, low NOx Region A, and the rapid increase in NOx produced in Region B above about 1450° C.;

DETAILED DESCRIPTION, INCLUDING THE BEST MODE OF CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives, and uses of the invention, including what are presently believed to be the best modes of carrying out the invention.

In this regard, the invention is illustrated in the several figures and tables, and is of sufficient complexity that the many parts, interrelationships, process steps, and subcombinations thereof simply cannot be fully illustrated in a single patent-type drawing or table. For clarity and conciseness, several of the drawings show in schematic, or omit, parts or steps that are not essential in that drawing to a description of a particular feature, aspect or principle of the invention being disclosed. Thus, the best mode embodiment of one feature may be shown in one drawing, and the best mode of another feature will be called out in another drawing. Process aspects of the invention are described by reference to one or more examples or test runs, which are merely exemplary of the many variations and parameters of operation under the principles of the invention.

Figure 3:
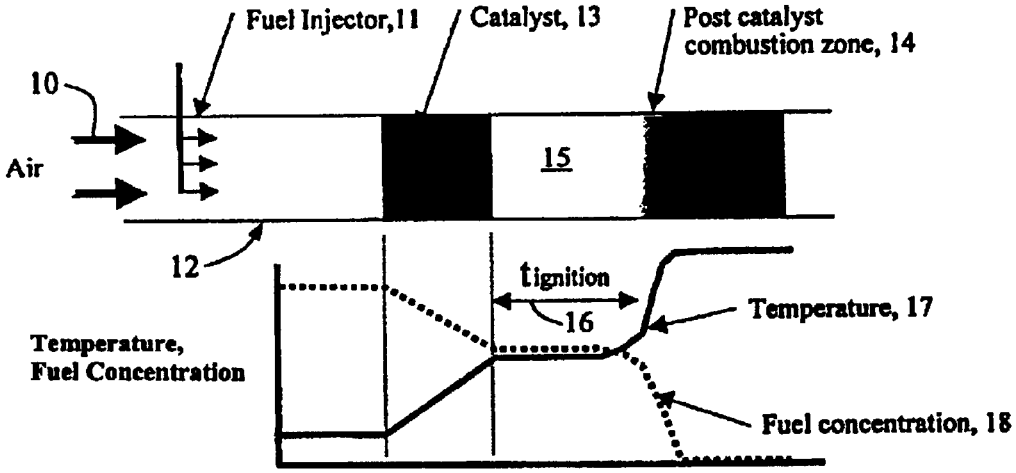
FIG. 3 is a schematic diagram of a catalytic combustion system showing the post catalyst homogeneous combustion zone (HC Zone) located downstream of the catalyst in which the remaining portion of the fuel is combusted.
Figure 4:
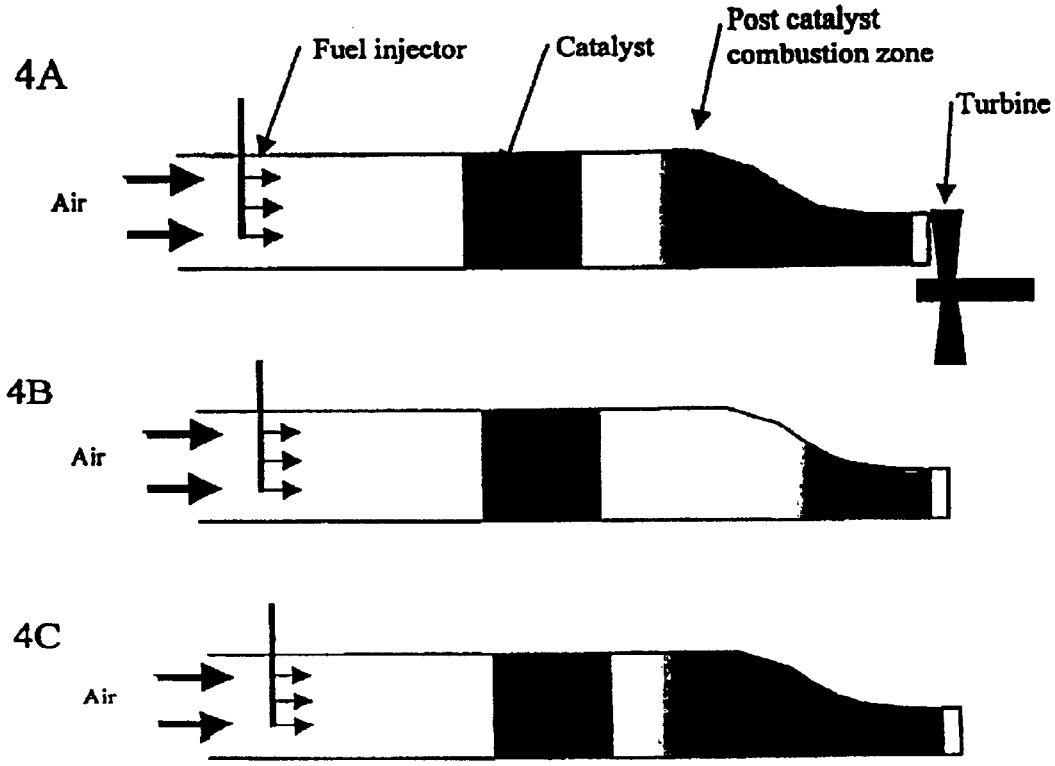
FIG. 4 is a multi-part schematic diagram of a catalytic combustion system showing changes in the position of the homogeneous combustion wave (HC Wave) in accord with the invention, FIG. 4A showing a general location, FIG. 4B showing long ignition delay moves the HC Wave further downstream toward the outlet to the turbine, and FIG. 4C showing shortening the ignition delay moves the HC Wave toward the catalyst module.
Figure 5:
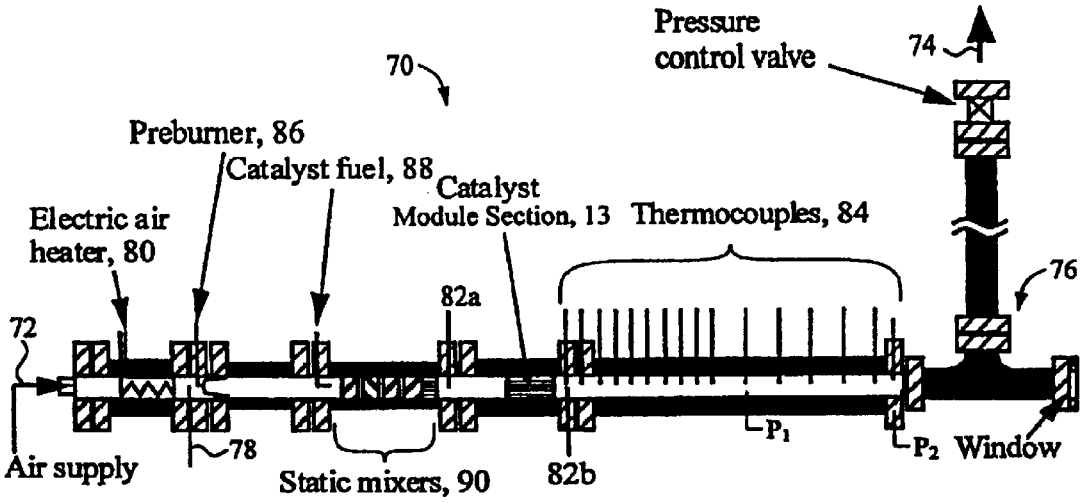
FIG. 5 is a partial section, diagrammatic views of the test rig.

FIG. 5 shows a catalyst module 13, having two stages in series, of the type shown in U.S. Pat. No. 5,512,250, installed in a tubular test rig 70. Ambient air 72 is introduced at one end and hot exhaust gases exit the test rig at outlet 74 off one leg of an observation Tee 76. A thermocouple 78 measured the temperature of the air just downstream of an electric air heater 80. Thermocouples 82*a* and 82*b* were installed upstream and downstream of the catalyst module 13, respectively, to measure the gas temperature both upstream and just downstream of the catalyst module. Additional thermocouples 84 were located spaced various distances downstream of the catalyst module to progressively measure the temperatures of the gas in the homogeneous combustion zone downstream of the catalyst section. In addition, two water-cooled gas-sampling probes, P1 and P2, were installed in the reactor to measure the composition of the gas stream at the position thirty-three cm (P1) and fifty-three cm (P2) downstream of the catalyst. Fuel was supplied to preburner 86, and catalyst fuel 88 was introduced just upstream of a series of static mixers 90 to insure thorough Fuel/Air mixing.

The test sequence was as follows:

1. Set air flow 7900 SLPM (standard liters per minute) and the pressure to 209 psig.
2. Set air temperature to about 450° C.
3. Increase fuel flow necessary for post-catalyst reaction-zone temperature of 1400° C.
4. Vary the catalyst inlet temperature and the fuel flow to cover a variety of combustor outlet temperatures and to move the homogeneous combustion wave to various locations in the post-catalyst reaction-zone.
5. At each point where stable operation is obtained, hold the operating conditions constant and measure the concentration of NOx (NO plus $NO_2$), $O_2$, and $CO_2$.
6. The NOx concentrations are then corrected to 15% $0_2$ concentration by applying the equation (1) below where "ppm (test)" is the measured value of NOx, "$0_2$" is the concentration of 02 at that measurement condition and "NOx, ppm (15% $0_2$)" is the NOx concentration corrected to 15% $0_2$.
7. NOx (ppm at 15% $0_2$)=NOx (ppm at test condition) X (20.9–15)1(20.9–02), Equation 1, with the results being shown in FIG. 6, NOx emissions in ppm as a function of the residence time and gas temperature after essentially complete combustion of the fuel.

Figure 6:
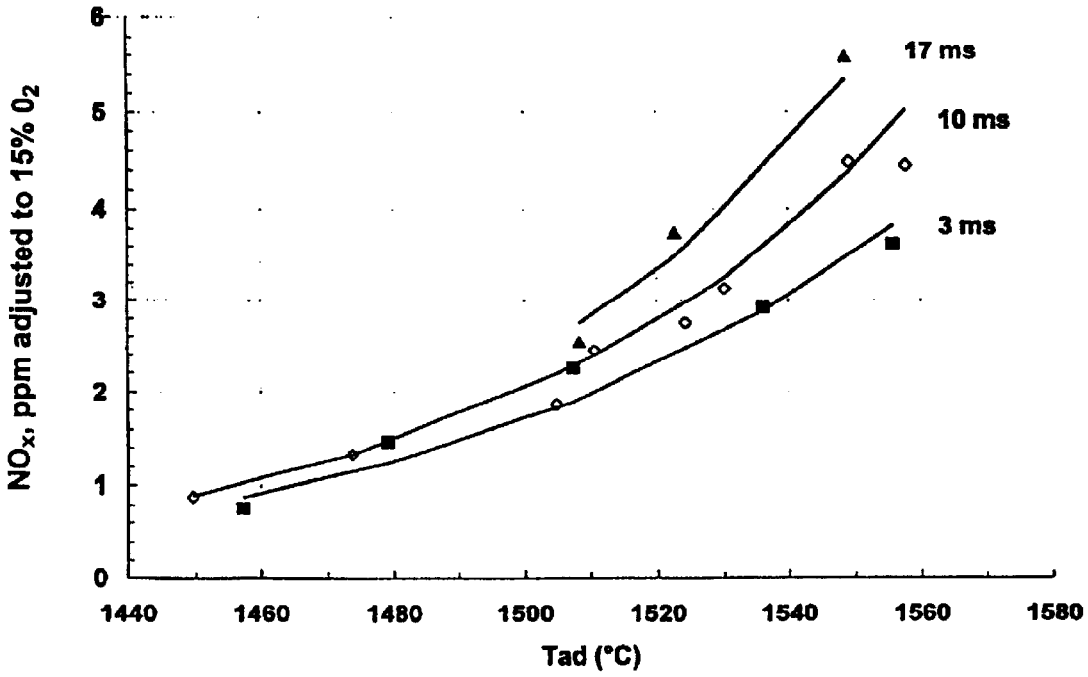
FIG. 6 is a graph of test results corrected to 15% $O_2$ using the test rig of FIG. 5 showing NOx emissions as a function of residence time after essentially complete combustion of the fuel in the HC Zone.

The residence time shown for the different curves of FIG. 6 is the time from: 1) the point where most of the fuel has combusted and the temperature has risen to approximately the maximum post-catalyst reaction zone temperature, to 2) the point at which the gas sample is taken for measurement of the NOx level. The test was run by determining the homogeneous combustion wave location and then moving the location of this combustion wave by changing the inlet temperature of the fuel/air mixture to the catalyst by changing the power to the electric air heater that heats the air in the test rig. As the catalyst inlet gases temperature is changed, the total fuel to the catalyst was changed to maintain a constant post-catalyst reaction zone temperature. As the fuel/air mixture inlet temperature (F/A temperature into the catalyst) was reduced, the homogeneous combustion wave moved downstream and shortened the residence time at high temperature. As the fuel/air mixture inlet temperature (F/A temperature into the catalyst) was increased, the homogeneous combustion wave moved toward the catalyst module and the residence time at high temperature increased. Over the entire temperature range studied, limiting the residence time to lower values reduced the NOx significantly. For example, at 1540° C., the NOx was reduced from 4.6 ppm to about 3 ppm or a reduction of 35%. At lower temperatures, the NOx level was lower, but operation at lower residence time still reduced the level of NOx.

On a gas turbine, the process by which the position of the homogeneous combustion wave can be controlled depends on the design of the catalytic combustion system. Where the catalyst inlet temperature is controlled by a flame burner, then the catalyst inlet temperature is controllable by changing the fuel flow to the flame burner. For example, in a fuel distribution proportioning embodiment of the invention, to decrease the level of NOx formed at a given turbine power output level where the drive turbine inlet temperature is to be held constant, the fraction of fuel fed to the preburner is decreased and the fraction of fuel fed to the catalyst fuel injector increased, so the total fuel fed to the gas turbine is held constant. Thus, by this proportional fuel flow control aspect of the invention, the total power output can be constant, yet since the fuel fed to the preburner has been decreased, the catalyst inlet and outlet temperatures are decreased and the homogeneous combustion wave is moved downstream to decrease the residence time at high temperature and the NOx level.

Other suitable processes for controlling catalyst inlet temperature will be evident to those skilled in the art for other combustor designs and for other combustion processes. Alternatively, holding the catalyst inlet temperature constant and varying the fuel to the catalyst also results in moving the homogeneous combustion wave. While this will also change the post-catalyst reaction zone temperature, that temperature change may be within an acceptable range for some combustion processes.

Figure 7:
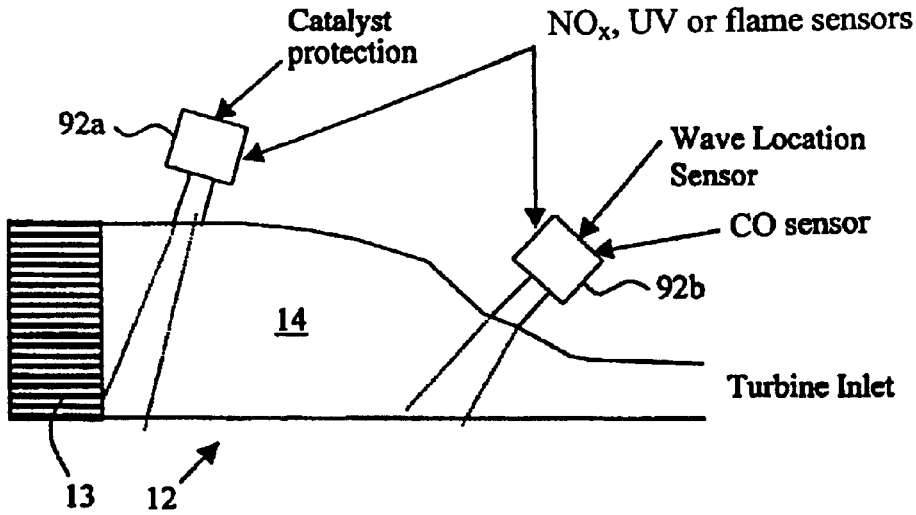
FIG. 7 is a schematic diagram of a portion of the combustor down stream of the catalyst module showing exemplary locations for ultraviolet sensors in the post-catalyst reaction zone.

Additional embodiments of the inventive system and method that can be used to advantage in a system that is designed for, or takes advantage of, the control of the residence time at high temperature to control NOx, include the following:

As shown in FIG. 7, one or more flame sensors 92 can be installed downstream of catalyst module in the post-catalyst combustion zone 14 of the combustor section 12 that are sensitive to the homogeneous combustion wave. For more detail on the location and use of sensors, particularly optical sensors, in connection with control of gas turbines employing catalytic combustion systems, see our co-pending application U.S. Ser. No. 09/942,976, filed Aug. 29, 2001, entitled CONTROL STRATEGY FOR FLEXIBLE CATALYTIC COMBUSTION SYSTEM, the disclosure of which is hereby incorporated by reference. Exemplary sensors include various types of ultraviolet sensors that are sensitive to the radiation produced from at least some of the radical reactions that occur in the radical reaction process for hydrocarbon and other fuels. Such a UV sensor, such as 92*a* can be oriented to "look at" the outlet end of the catalyst module to protect it from over-temperature, as where the HC Wave encroaches on the catalyst module. A preferred position for a sensor is downstream adjacent the outlet to the turbine, as shown at the right of FIG. 7, where sensor 92*b* is positioned to be exposed to the homogeneous combustion wave when it is in the desired location. The signal of this sensor, or a series of such sensors disposed parallel to the longitudinal axis of the combustion zone, can then be used to control the combustion process, in particular to control the catalyst inlet temperature, e.g., by control of the F/A mixture entering the catalyst in accord with the inventive process to hold the homogenous combustion process in a particular, predetermined, desired location in order to limit the formation of NOx to a preselected level, e.g., to <3 ppm, preferably below about 2 ppm, and most preferably below about 1 ppm.

A second type of sensor that can be used in a manner, and located in positions, similar to the above ultraviolet-type sensor, is an ion sensor whose signal is some function of the concentration of ionized gas molecules in the region near the sensor. Such sensors typically measure ion current between a pair of electrically charged plates or electrodes. Such a sensor, or array of suitably located sensors, can be positioned in the post catalyst reaction zone to monitor the location of the homogeneous combustion wave.

Thermocouples can be located in post-catalyst reaction zone to measure gas temperature and thus the location of the homogeneous combustion wave, sine the gas temperature rises substantially at the location of this combustion wave. Alternatively, thermocouples can be positioned to measure the combustion zone wall temperature (typically metal walls). Since the metal wall is in heat transfer relationship with the hot gases, the temperature rise in the gas at the location of the homogeneous combustion wave would be reflected as a corresponding temperature rise in the metal wall temperature.

In cases where all of the operating parameters of the system are well understood and the important system parameters can be measured, then an empirical model of the combustor can be used to calculate the location of the HC Wave. This calculated value is then used in a control system algorithm to control the location of the HC Wave. This is an example of a "model based control strategy".

Figure 8:
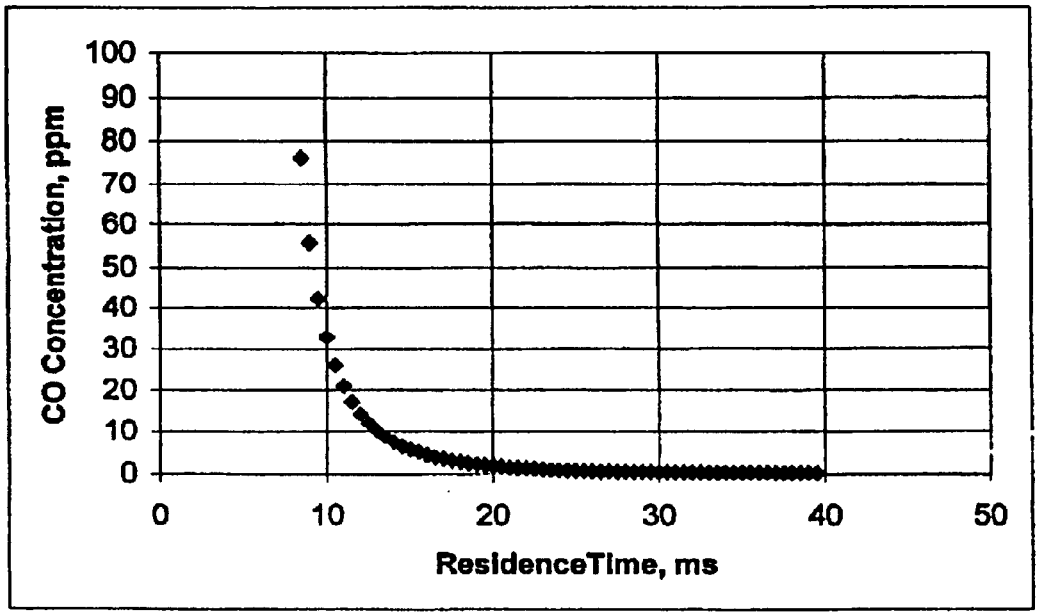
FIG. 8 is a graph of the CO concentration profile, in ppm CO vs Residence Time, in the post catalyst reaction zone.

As the combustion wave moves very close to the combustor outlet or (turbine inlet), the CO level in the turbine exhaust may increase due to the fact that the reaction time in the HC Wave is too short to obtain complete reaction of the CO (oxidation to C02) within the combustor burnout zone. The CO concentration entering the drive turbine and also exiting the turbine exhaust will be as shown in FIG. 8, which is derived for a selected set of turbine and catalytic combustor operating conditions. The "knee" in the curve is at approximately 10 ppm CO, 13 ms Residence Time. Shorter residence times cause the CO to rapidly increase, while longer residence times can reduce the CO output to <10 ppm as shown in the curve. However, this is counter to the NOx curve, in that the shorter residence time means the HC Wave is farther from the catalyst unit with a corresponding shorter residence time at high temperature in the post catalytic reaction zone, and less NOx is produced. Thus, the invention provides principles by which the operating parameters are adjusted by the controller to achieve this very difficult low NOx/low CO/high Power Output target window. Controlling the gas turbine so that the CO concentration is on the curve of FIG. 8, below about 100 ppm, and preferably in the vicinity of the knee in the curve of FIG. 8, <10 ppm and most preferably <5 ppm, still permits the HC Wave to be maintained at the desired location (residence time short, ignition delay long) for low NOx production. Thus, monitoring the CO level with CO sensors can be used to control the position of the HC Wave. The sensor 92*b* shown in FIG. 7 can be a CO breakthrough sensor, the readings of which are monitored and fed back to the controller, e.g., for F/A adjustment to control the HC Wave location. Alternatively, the CO sensor can measure the CO in the turbine exhaust (see FIG. 1) and the CO level sensor signal used as an input to a controller for control of the position of the HC Wave. One exemplary control strategy is to periodically change the combustor operating conditions so that the HC Wave is moved closer to or further away from the post catalyst reaction zone exit and monitor the CO level in the turbine exhaust. In this manner, the optimum operating conditions corresponding to a CO level in the range of 5 or 10 ppm CO can be determined and the turbine then can be controlled at this operating condition using an operating line control strategy as described in the aforesaid copending application Ser. No. 09/942,976 filed Aug. 29, 2001, the disclosure of which is hereby incorporated by reference.

Similarly, one or more NOx sensors in the HC Zone can be employed in locations as described above for FIG. 7. The sensor outputs are used to control the hot turbine inlet gases to a specified NOx level by controlling the above-described parameters that adjust the position of the homogeneous combustion wave.

The actual location of the homogeneous combustion wave can be controlled by varying the following system or operating parameters:

a. Changing the catalyst inlet temperature;

b. Changing the fraction of air bypassing the catalyst to thus change the fuel/air ratio through the catalyst. Since the total turbine air flow and total turbine fuel flow is not changed, the turbine inlet temperature and load operating point will remain the same;

c. Adjusting the air to the preburner, e.g., by overboard bleed of compressor discharge air upstream of the preburner which increases the fuel air ratio of the mixture in the catalyst and changes the position of the homogenous combustion wave;

d. Changing the composition of the fuel mixture by adding or removing components that would effect the ignition delay time. Longer chain hydrocarbons or hydrogen, for example, will shorten the ignition delay time;

e. Addition of water to the compressor inlet or to the combustor to increase total mass flow and thus modify the gas velocity and other operating conditions and thus change the position of the homogeneous combustion wave; and f. Fuel distribution proportioning as between the preburner and the catalyst module.

Industrial Applicability:

It is clear that the process and apparatus of the invention will have wide industrial applicability, not only to catalytic combustion systems for gas turbines, but also to combustors employed in a variety of other types of power and hot gas producing systems, such as industrial boilers for steam and process heat.

The reduction in NOx while maintaining CO within acceptable limits and not sacrificing power output under the inventive process and apparatus is environmentally beneficial, offering the potential for significant amelioration in NOx produced by high temperature combustion processes, thus lending the invention a wide industrial applicability.

It should be understood that one of ordinary skill in the art can make various modifications within the scope of this invention without departing from the spirit thereof. It is therefore wished that this invention be defined by the scope of the appended claims as broadly as the prior art will permit, and in view of the specification if need be.

What is claimed is:

1. A method for operating catalytic combustor, comprising:

catalytically combusting a fuel-air mixture in a combustor, wherein at least a portion of the fuel-air mixture is combusted in a homogeneous combustion wave within a post catalyst burnout zone located downstream of a catalyst to form hot combustion gases; and controlling the residence time of the hot combustion gases within the post catalyst burn out zone to control the production of thermal NOx while maintaining a substantially constant adiabatic temperature.

2. The method of claim 1 wherein the residence time is controlled by controlling the location of the homogeneous combustion wave with respect to an outlet of the combustor.

3. The method of claim 1, wherein the residence time is controlled to reduce the production of NOx below a preselected level.

4. The method of claim 3, wherein the preselected level is 3 ppm.

5. The method of claim 3, wherein the preselected level is 2 ppm.

6. The method of claim 1, wherein controlling the residence time of the hot combustion gases within the post catalyst burnout zone further includes controlling the production of CO below a preselected level.

7. The method of claim 6, wherein the preselected level of the production of CO is 100 ppm.

8. The method of claim 6, wherein the preselected level of the production of CO is 10 ppm.

9. The method of claim 1, wherein the residence time is controlled to reduce the production of NOx below a preselected level and the production of CO below a preselected level.

10. The method of claim 1, wherein, the hot combustion gases have a temperature above 1450° C. during the residence time, and the residence time is controlled such that the production of NOx is below approximately 3 ppm and the production of CO is below approximately 100 ppm.

11. The method of claim 10, wherein NOx is produced below approximately 2 ppm and CO is produced below approximately 10 ppm.

12. The method of claim 1, wherein the controlling includes monitoring at least one characteristic of at least one of the fuel-air mixture and the hot combustion gas to control the residence time.

13. The method of claim 12, wherein the monitoring includes sensing at least one of fuel amount, air flow rate, fuel feed rate, fuel-air mixture temperature, hot combustion gas temperature, the production of NOx, and the production of CO.

14. The method of claim 1, wherein the production of NOx and the production of CO are monitored, and the residence time is controlled to reduce NOx below a preselected level while maintaining CO below a preselected level.

15. The method of claim 1, wherein controlling the residence time includes adjusting the catalyst outlet gas temperature to control the delay time for ignition of the fuel in the homogenous combustion wave.

16. The method of claim 15, wherein the catalyst outlet gas temperature is adjusted by controlling the temperature of the fuel-air mixture entering the catalyst.

17. The method of claim 16, wherein the combustor includes a preburner upstream of the catalyst, and the temperature of at least one of the fuel-air mixture and the catalyst outlet gas is controlled by at least one of:

adjusting the fraction of air bypassing the catalyst, adjusting the fuel supplied to the combustor by proportioning the fuel supplied between the catalyst and the preburner, adjusting air input to the preburner, adjusting the composition of the fuel by introduction of components that affect the ignition delay time, and introducing water in at least one of upstream of the combustor and in the combustor.

18. The method of claim 17, wherein the temperature of the hot combustion gas is maintained in a predetermined range for energy extraction and the fuel supplied to the preburner is controlled to move the homogenous combustion wave to a location to reduce NOx production while maintaining CO production below about 50 ppm.

19. The method of claim 1, wherein the controlling includes utilizing an empirical model of the operation of the combustor under a range of operating parameters, calculating the residence time of the hot combustion gases in the combustor as the parameters change, and setting system operating controls to selectively position the location of the homogeneous wave to achieve a desired residence time.

20. A method for operating a catalytic combustor, comprising:

catalytically combusting a fuel-air mixture in a combustor, wherein at least a portion of the fuel-air mixture is combusted in a homogeneous combustion wave within a post catalyst burnout zone located downstream of a catalyst to form hot combustion gases; and controlling the residence time of the hot combustion gases within the post catalyst burn out zone to control the production of thermal NOx, wherein the residence time is controlled by controlling the location of the homogeneous combustion wave with respect to an outlet of the combustor.

21. The method of claim 20, wherein the residence time is controlled to reduce the production of NOx below a preselected level.

22. The method of claim 21, wherein the preselected level is 3 ppm.

23. The method of claim 21, wherein the preselected level is 2 ppm.

24. The method of claim 20, wherein controlling the residence time of the hot combustion gases within the post catalyst burnout zone further includes controlling the production of CO below a preselected level.

25. The method of claim 24, wherein the preselected level of the production of CO is 100 ppm.

26. The method of claim 24, wherein the preselected level of the production of CO is 10 ppm.

27. The method of claim 20, wherein the residence time is controlled to reduce the production of NOx below a preselected level and the production of CO below a preselected level.

28. The method of claim 20, wherein, the hot combustion gases have a temperature above 1450° C. during the residence time, and the residence time is controlled such that the production of NOx is below approximately 3 ppm and the production of CO is below approximately 100 ppm.

29. The method of claim 28, wherein NOx is produced below approximately 2 ppm and CO is produced below approximately 10 ppm.

30. The method of claim 20, wherein the controlling includes monitoring at least one characteristic of at least one of the fuel-air mixture and the hot combustion gas to control the residence time.

31. The method of claim 30, wherein the monitoring includes sensing at least one of fuel amount, air flow rate, fuel feed rate, fuel-air mixture temperature, hot combustion gas temperature, the production of NOx, and the production of CO.

32. The method of claim 20, wherein the production of NOx and the production of CO are monitored, and the residence time is controlled to reduce NOx below a preselected level while maintaining CO below a preselected level.

33. The method of claim 20, wherein controlling the residence time includes adjusting the catalyst outlet gas temperature to control the delay time for ignition of the fuel in the homogenous combustion wave.

34. The method of claim 33, wherein the catalyst outlet gas temperature is adjusted by controlling the temperature of the fuel-air mixture entering the catalyst.

35. The method of claim 34, wherein the combustor includes a preburner upstream of the catalyst, and the temperature of at least one of the fuel-air mixture and the catalyst outlet gas is controlled by at least one of:

adjusting the fraction of air bypassing the catalyst, adjusting the fuel supplied to the combustor by proportioning the fuel supplied between the catalyst and the preburner, adjusting air input to the preburner, adjusting the composition of the fuel by introduction of components that affect the ignition delay time, and introducing water in at least one of upstream of the combustor and in the combustor.

36. The method of claim 35, wherein the temperature of the hot combustion gas is maintained in a predetermined range for energy extraction and the fuel supplied to the preburner is controlled to move the homogenous combustion wave to a location to reduce NOx production while maintaining CO production below about 50 ppm.

37. The method of claim 20, wherein the controlling includes utilizing an empirical model of the operation of the combustor under a range of operating parameters, calculating the residence time of the hot combustion gases in the combustor as the parameters change, and setting system operating controls to selectively position the location of the homogeneous wave to achieve a desired residence time.

38. A method for operating a catalytic combustor, comprising:

catalytically combusting a fuel-air mixture in a combustor, wherein at least a portion of the fuel-air mixture is combusted in a homogeneous combustion wave within a post catalyst burnout zone located downstream of a catalyst to form hot combustion gases; and controlling the residence time of the hot combustion gases within the post catalyst burn out zone to control the production of thermal NOx, wherein controlling the residence time includes adjusting the catalyst outlet gas temperature to control the delay time for ignition of the fuel in the homogenous combustion wave.

39. The method of claim 38, wherein the catalyst outlet gas temperature is adjusted by controlling the temperature of the entering the catalyst.

40. The method of claim 38 wherein the residence time is controlled by controlling the location of the homogeneous combustion wave with respect to an outlet of the combustor.

41. The method of claim 38, wherein the residence time is controlled to reduce the production of NOx below a preselected level.

42. The method of claim 41, wherein the preselected level is 3 ppm.

43. The method of claim 41, wherein the preselected level is 2 ppm.

44. The method of claim 38, wherein controlling the residence time of the hot combustion gases within the post catalyst burnout zone further includes controlling the production of CO below a preselected level.

45. The method of claim 44, wherein the preselected level of the production of CO is 100 ppm.

46. The method of claim 44, wherein the preselected level of the production of CO is 10 ppm.

47. The method of claim 38, wherein the residence time is controlled to reduce the production of NOx below a preselected level and the production of CO below a preselected level.

48. The method wherein, the hot combustion gases have a temperature above 1450° C during the residence time, and the residence time is controlled such that the production of NOx is below approximately 3 ppm and the production of CO is below approximately 100 ppm.

49. The method of claim 48, wherein NOx is produced below approximately 2 ppm and CO is produced below approximately 10 ppm.

50. The method of claim 38, wherein the controlling includes monitoring at least one characteristic of at least one of the fuel-air mixture and the hot combustion gas to control the residence time.

51. The method of claim 50, wherein the monitoring includes sensing at least one of fuel amount, air flow rate, fuel feed rate, fuel-air mixture temperature, hot combustion gas temperature, the production of NOx, and the production of CO.

52. The method of claim 38, wherein the production of NOx and the production of CO are monitored, and the residence time is controlled to reduce NOx below a preselected level while maintaining CO below a preselected level.

53. The method of claim 38, wherein the combustor includes a preburner upstream of the catalyst, and the temperature of at least one of the fuel-air mixture and the catalyst outlet gas is controlled by at least one of:

adjusting the fraction of air bypassing the catalyst, adjusting the fuel supplied to the combustor by proportioning the fuel supplied between the catalyst and the preburner, adjusting air input to the preburner, adjusting the composition of the fuel by introduction of components that affect the ignition delay time, and introducing water in at least one of upstream of the combustor and in the combustor.

54. The method of claim 53, wherein the temperature of the hot combustion gas is maintained in a predetermined range for energy extraction and the fuel supplied the preburner is controlled to move the homogenous combustion wave to a location to reduce NOx production while maintaining CO production below about 50 ppm.

55. The method of claim 38, wherein the controlling includes utilizing an empirical model of the operation of the combustor under a range of operating parameters, calculating the residence time of the hot combustion gases in the combustor as the parameters change, and setting system operating controls to selectively position the location of the homogeneous wave to achieve a desired residence time.

* * * * *